US006724244B2

(12) United States Patent
Wu

(10) Patent No.: US 6,724,244 B2
(45) Date of Patent: Apr. 20, 2004

(54) STABLE CURRENT SOURCE CIRCUIT WITH COMPENSATION CIRCUIT

(75) Inventor: Li-Te Wu, Hsinchu (TW)

(73) Assignee: Winbond Electronics Corp., Hsinchu (TW)

( * ) Notice: Subject to any disclaimer, the term of this patent is extended or adjusted under 35 U.S.C. 154(b) by 0 days.

(21) Appl. No.: 10/227,811

(22) Filed: Aug. 27, 2002

(65) Prior Publication Data

US 2004/0041622 A1 Mar. 4, 2004

(51) Int. Cl.[7] ..... G05F 1/10

(52) U.S. Cl. ..... 327/543

(58) Field of Search ..... 327/530, 534, 327/535, 538, 543

(56) References Cited

U.S. PATENT DOCUMENTS

| | | | | |
|---|---|---|---|---|
| 5,955,874 A | * | 9/1999 | Zhou et al. | 323/315 |
| 6,342,781 B1 | * | 1/2002 | Laraia | 323/313 |
| 6,348,832 B1 | * | 2/2002 | Chih | 327/538 |
| 6,348,835 B1 | * | 2/2002 | Sato et al. | 327/543 |

* cited by examiner

*Primary Examiner*—Jeffrey Zweizig
(74) *Attorney, Agent, or Firm*—Bacon & Thomas, PLLC

(57) ABSTRACT

A stable current source circuit with a compensation circuit, comprising: a PMOS current mirror, connected to a power supply so as to output a stable current; an NMOS current mirror, connected to a third bipolar junction transistor and a fourth compensation resistor; a third bipolar junction transistor, the emitter of the third bipolar junction transistor connected to the NMOS current mirror and both of the base and the collector grounded; and a fourth compensation resistor, interconnected between the NMOS current mirror and the compensation circuit. Alternatively, a compensation capacitor can be added so as to obtain better stability.

17 Claims, 5 Drawing Sheets

STABLE CURRENT SOURCE CIRCUIT WITH COMPENSATION CIRCUIT

BACKGROUND OF THE INVENTION

1. Field of the Invention

The present invention generally relates to a stable current source circuit and, more particularly to a stable current source circuit employing a compensation circuit to output a stable current.

2. Description of the Prior Art

In an oscillator and a digital-to-analog converter (DAC), a stable and variable bias current is required. Generally, a current source circuit comprises an internal resistor and a diode so as to provide a stable output current. In order to adjust the output current, those who are skilled in this art employ an external resistor to replace the internal resistor. However, the current flowing on the external may be disturbed due to an external capacitor. To overcome such a problem, a resistor and a capacitor are added. The capacitor and the external resistor result in a pole and a zero in the transfer function such that the oscillation of the bias circuit is reduced and the closed-loop gain becomes less than 1. Therefore, the current can keep stable.

In a prior art embodiment as shown in FIG. 1, an NMOS current mirror is composed of a first NMOS transistor N11 and a second NMOS transistor N12 with the gates of the two transistors connected. A positive feedback loop is formed of a PMOS current mirror composed of a first PMOS transistor P11 and a second PMOS transistor P12 with the gates of the two transistors connected and a third PMOS transistor P13. With a first resistor R11, the gain of the circuit as shown in FIG. 1 is less than 1 so that the current remains stable.

In another prior art embodiment as shown in FIG. 2, an NMOS current mirror is composed of a third NMOS transistor N21 and a fourth NMOS transistor N22 with the gates of the two transistors connected. A positive feedback loop is formed of a PMOS current mirror composed of a fourth PMOS transistor P21 and a fifth PMOS transistor P22 with the gates of the two transistors connected and a sixth PMOS transistor P23. With a second resistor R21 and a first capacitor C21, the gain of the circuit as shown in FIG. 2 is larger than 1 so that the current remains unstable.

Therefore, there is need in providing a stable current source circuit to output a stable current.

SUMMARY OF THE INVENTION

Accordingly, it is the primary object of the present invention to provide a stable current source circuit with an external resistor.

In order to achieve the foregoing object, the present invention provides a stable current source circuit with a compensation circuit, comprising: a PMOS current mirror, connected to a power supply so as to output a stable current; an NMOS current mirror, connected to a third bipolar junction transistor and a fourth compensation resistor; a third bipolar junction transistor, the emitter of the third bipolar junction transistor connected to the NMOS current mirror and both of the base and the collector grounded; and a fourth compensation resistor, interconnected between the NMOS current mirror and the compensation circuit.

The present invention further provides a stable current source circuit with a compensation circuit, comprising: a PMOS current mirror, connected to a power supply so as to output a stable current; an NMOS current mirror, connected to a fourth bipolar junction transistor and a sixth compensation resistor; a fourth bipolar junction transistor, the emitter of the fourth bipolar junction transistor connected to the NMOS current mirror and both of the base and the collector grounded; a sixth compensation resistor, interconnected between the NMOS current mirror and the compensation circuit; and a fourth compensation capacitor, interconnected between the source and the drain of an NMOS transistor of the NMOS current mirror.

Other and further features, advantages and benefits of the invention will become apparent in the following description taken in conjunction with the following drawings. It is to be understood that the foregoing general description and following detailed description are exemplary and explanatory but are not to be restrictive of the invention. The accompanying drawings are incorporated in and constitute a part of this application and, together with the description, serve to explain the principles of the invention in general terms.

BRIEF DESCRIPTION OF THE DRAWINGS

The objects, spirits and advantages of the preferred embodiments of the present invention will be readily understood by the accompanying drawings and detailed descriptions, wherein.

DETAILED DESCRIPTION OF THE INVENTION

The present invention providing a stable current source circuit with a compensation circuit can be exemplified by the preferred embodiments as described hereinafter.

Figure 3:
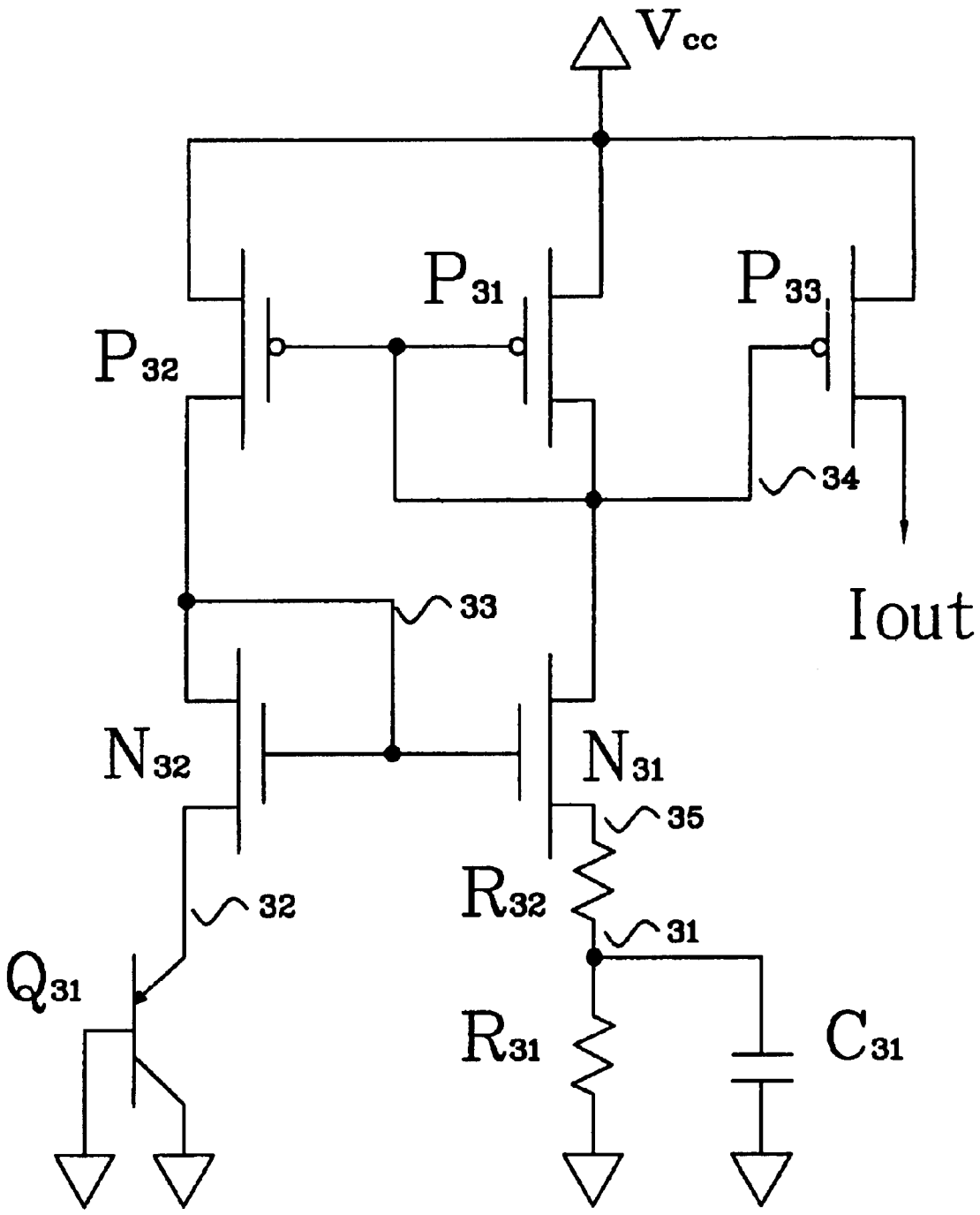
FIG. 3 is a stable current source with a compensation resistor circuit in accordance with one preferred embodiment of the present invention.

Please refer to FIG. 3, which is a stable current source with an external compensation circuit comprising a single resistor in accordance with one preferred embodiment of the present invention. As shown in the figure, the circuit comprises: an NMOS current mirror composed of a fifth NMOS transistor N31 and a sixth NMOS transistor N32 with the gates of the two transistors connected; a PMOS current mirror composed of a seventh PMOS transistor P31 and an eighth PMOS transistor P32 with the gates of the two transistors connected; a ninth PMOS transistor P33; a third resistor R31; a fourth compensation resistor R32; a second capacitor C31; a power supply VCC; and a third bipolar junction transistor (BJT) Q31.

More particularly, the source of the seventh PMOS transistor P31, the source of the eighth PMOS transistor P32 and the source of the ninth PMOS transistor P33 are connected to the power supply VCC. The substrate of the seventh PMOS transistor P31, the substrate of the eighth PMOS transistor P32 and the substrate of the ninth PMOS transistor P33 are connected to the power supply VCC. The substrate of the fifth NMOS transistor N31 and the substrate of the sixth NMOS transistor N32 are grounded.

Moreover, the source of the sixth NMOS transistor N32, the emitter of the third bipolar junction transistor (BJT) Q31 are connected via a wiring line 32. The drain and the gate of the sixth NMOS transistor N32, the gate of the fifth NMOS transistor N31 and the drain of the eighth PMOS transistor P32 are connected via a wiring line 33. The gate of the seventh PMOS transistor P31 and the gate of the eighth PMOS transistor P32 are connected, thereby forming a PMOS current mirror. The node between the two gates of the PMOS current mirror is further connected, via a wiring line 34, to the gate of the ninth PMOS transistor P33, the drain of the seventh PMOS transistor P31 and the drain of the fifth NMOS transistor N31. The base and the collector of the third bipolar junction transistor Q31 are grounded.

Furthermore, the source of the fifth NMOS transistor N31 and one terminal of the fourth compensation resistor R32 are connected at a node 35. The other terminal of the fourth compensation resistor R32 and one terminal of the second capacitor C31 are connected at a node 31. The other terminal of the second capacitor C31 is grounded. In order to adjust the output current, the third resistor R31 is externally connected between the node 31 and the ground. In addition, the drain of the ninth PMOS transistor P33 outputs an output current Iout.

Figure 1:
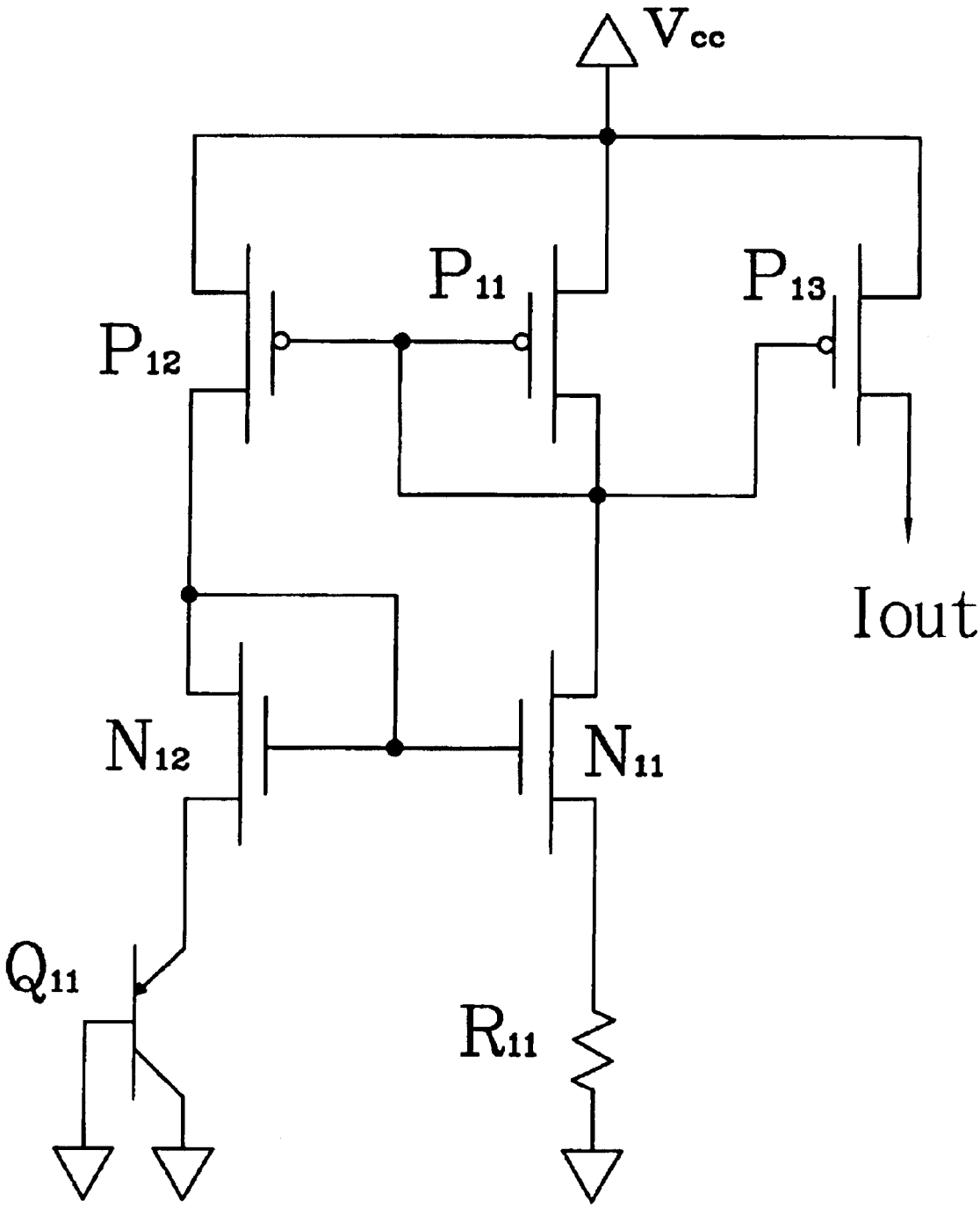
FIG. 1 (PRIOR ART)
FIG. 1 is a conventional current source circuit in accordance with the prior art.
Figure 2:
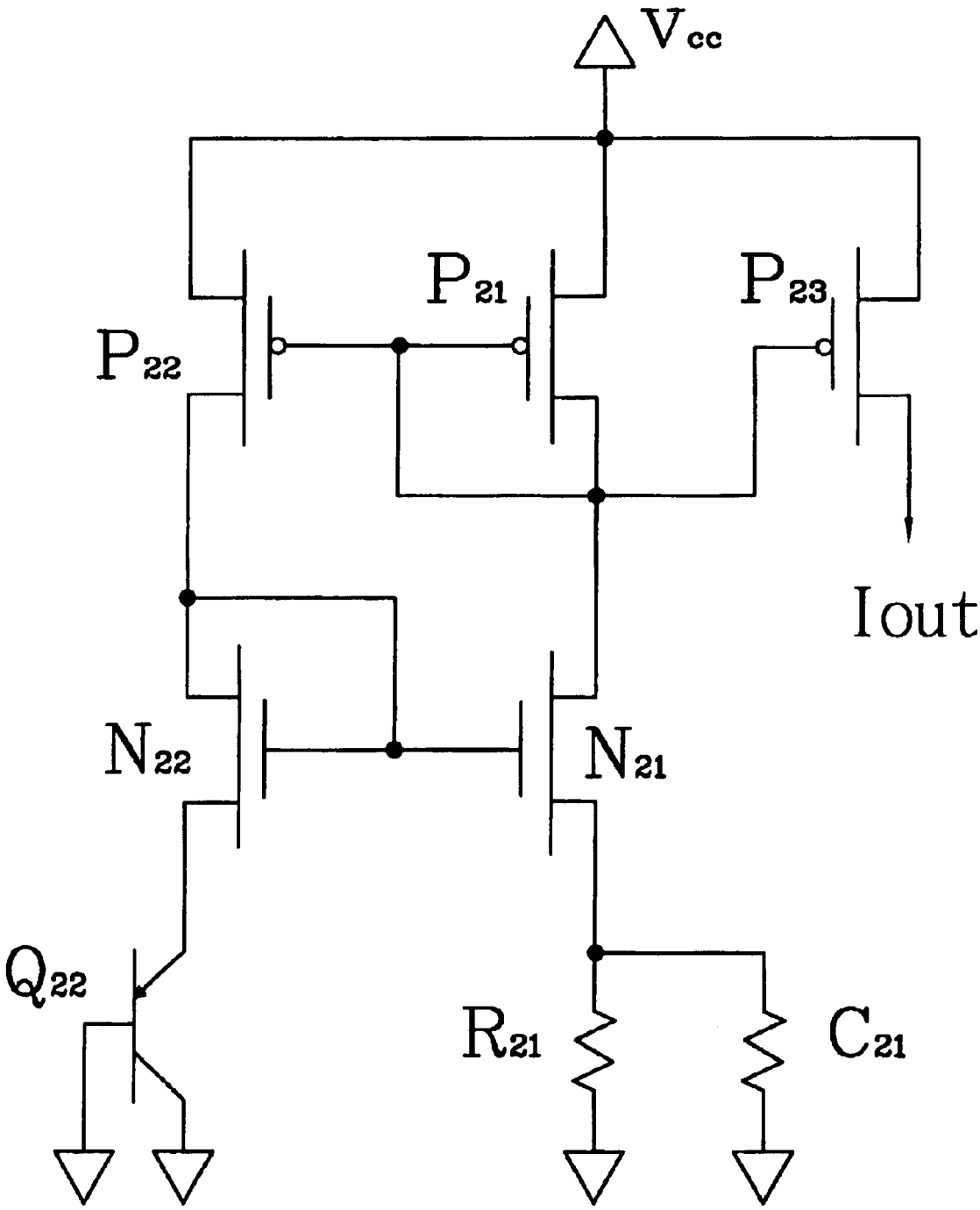
FIG. 2 (PRIOR ART)
FIG. 2 is another conventional current source circuit in accordance with the prior art.

In order to reduce the closed-loop gain to less than 1, as shown in FIG. 1, the fourth compensation resistor R32 is connected to the fifth NMOS transistor N31 at node 35 and to the third resistor R31 at node 31. Therefore, with the fourth compensation resistor R32, the output current can be varied. In the present invention, the resistance of the external resistor R31 is reduced so as to obtain an output current identical to that without the compensation resistor R32.

Accordingly, in a small bias case where the third resistor R31 is small, a stable output current can be obtained with the fourth compensation resistor R32. However, in a large bias case where the third resistor R31 is large, the fourth compensation resistor R32 should be increased so as to obtain a stable current.

Figure 4:
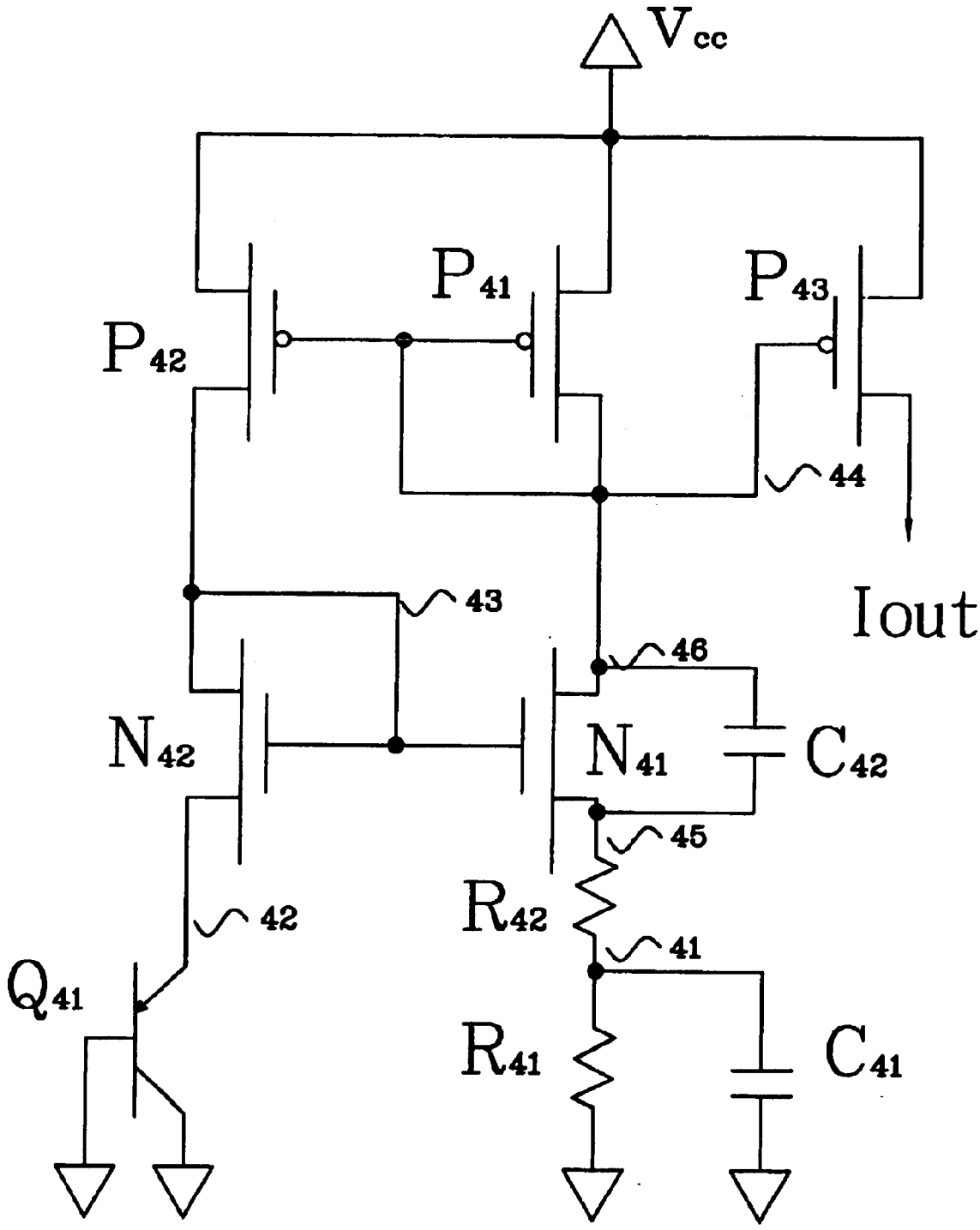
FIG. 4 is a stable current source with a compensation resistor circuit and a compensation capacitor in accordance with another preferred embodiment of the present invention.

Please refer to FIG. 4, which is a stable current source with an external compensation circuit comprising a resistor and a capacitor in accordance with another preferred embodiment of the present invention. Better stability can be obtained by using such a circuit as shown in FIG. 4.

As shown in FIG. 4, the circuit comprises: an NMOS current mirror composed of a seventh NMOS transistor N41 and an eighth NMOS transistor N42 with the gates of the two transistors connected; a PMOS current mirror composed of a tenth PMOS transistor P41 and an eleventh PMOS transistor P42 with the gates of the two transistors connected; a twelfth PMOS transistor P43; a fifth resistor R41; a sixth compensation resistor R42; a third capacitor C41; a fourth compensation capacitor C42; a power supply VCC; and a fourth bipolar junction transistor (BJT) Q41.

More particularly, the source of the tenth PMOS transistor P41, the source of the eleventh PMOS transistor P42 and the source of the twelfth PMOS transistor P43 are connected to the power supply VCC. The substrate of the tenth PMOS transistor P41, the substrate of the eleventh PMOS transistor P42 and the substrate of the twelfth PMOS transistor P43 are connected to the power supply VCC. The substrate of the seventh NMOS transistor N41 and the substrate of the eighth NMOS transistor N42 are grounded.

Moreover, the source of the eighth NMOS transistor N42, the emitter of the fourth bipolar junction transistor (BJT) Q41 are connected via a wiring line 42. The drain and the gate of the eighth NMOS transistor N42, the gate of the seventh NMOS transistor N41 and the drain of the eleventh PMOS transistor P42 are connected via a wiring line 43. The gate of the tenth PMOS transistor P41 and the gate of the eleventh PMOS transistor P42 are connected, thereby forming a PMOS current mirror. The node between the two gates of the PMOS current mirror is further connected, via a wiring line 44, to the gate of the twelfth PMOS transistor P43, the drain of the tenth PMOS transistor P41 and the drain of the seventh NMOS transistor N41. The base and the collector of the fourth bipolar junction transistor Q41 are grounded.

Furthermore, the source of the seventh NMOS transistor N41 and one terminal of the sixth compensation resistor R42 are connected at a node 45. The other terminal of the sixth compensation resistor R42 and one terminal of the third capacitor C41 are connected at a node 41. The other terminal of the third capacitor C41 is grounded. In order to adjust the output current, the fifth resistor R41 is externally connected between the node 41 and the ground. In addition, the drain of the twelfth PMOS transistor P43 outputs an output current Iout. In addition, a fourth compensation capacitor C42 is interconnected between the drain (at a node 46) and the source (at a node 45) of the seventh NMOS transistor N41. The sixth compensation resistor R42 is connected to the seventh NMOS transistor N41 at node 45 and to the fifth resistor R41 at node 41.

Figure 5:
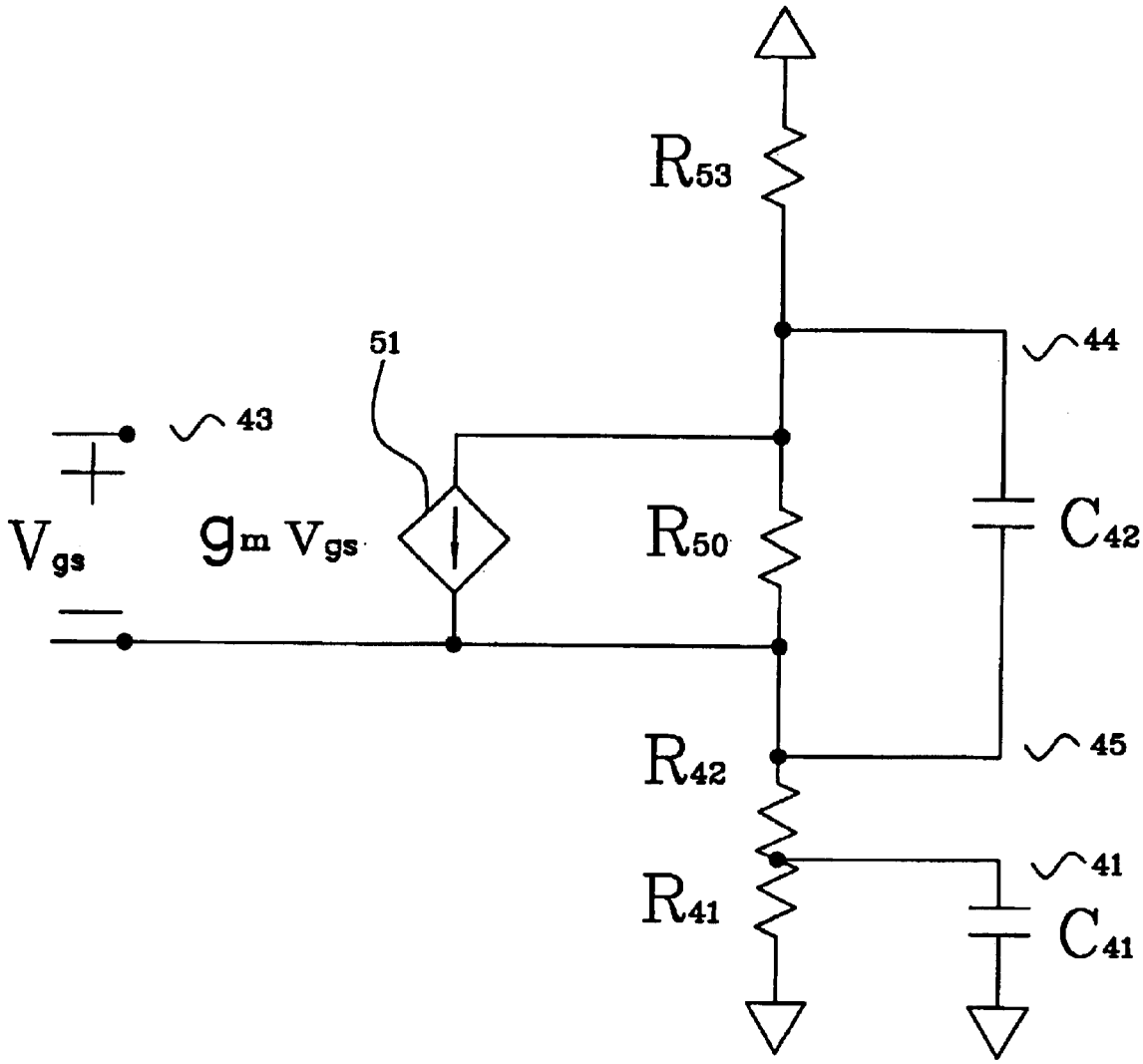
FIG. 5 is a circuit showing the small signal model of the transistors and the equivalent load resistor in accordance with the present invention.

For further analysis, please refer to FIG. 5, which is a circuit showing the small signal model of the MOS transistors and the equivalent load resistor R50 in accordance with the seventh NMOS transistor N41 and the eighth NMOS transistor N42 in FIG. 4. A load resistor R53 is used to replace the twelfth PMOS transistor P43. Therefore, the small signal gain of the circuit in FIG. 5 can be expressed as:

$$gain \equiv \frac{V_o(s)}{V_i(s)} = \frac{V_{44}}{V_{43}} = -g_m R_L \frac{Z_o}{Z_o + R_L + Z}$$

where $R_L$ is the resistance of the resistor R53, $V_{43}$ is the bias voltage at the node 43, $V_{44}$ is the bias voltage at the node 44, $$Z_o = R_{50} \left\| \frac{1}{sC_{42}} \right., \quad and$$

$$Z = R_{42} + \left( R_{41} \left\| \frac{1}{sC_{41}} \right. \right)$$

Therefore, the small signal gain becomes $$gain \equiv -g_m (R_{53} \| R_{50}) \frac{(1 + sC_{41}R_{41})}{(1 + sC_{41}R_{41})(1 + sC_{42}(R_{53} \| R_{50})) + (1 + sC_{41}(R_{41} \| R_{42}))\left(\frac{R_{41} + R_{42}}{R_{50} + R_{53}}\right)}$$

The third capacitor C41 and the fifth resistor R41 may cause an increase in the close-loop gain of the circuit. Such a problem can be to overcome by employing the sixth compensation resistor R42 and the fourth compensation capacitor C42.

According to the present invention, the first preferred embodiment demonstrates a stable current source with a compensation resistor circuit, in which the fourth resistor R32 is employed so as to output a st0able bias current; and the second preferred embodiment shows a stable current source with a compensation resistor circuit, in which the sixth resistor R42 and the fourth capacitor C42 are used so as to output a stable bias current.

According to the above discussion, it is apparent that the present invention discloses a stable current source circuit with a compensation circuit. Therefore, the present invention has been examined to be progressive, advantageous and applicable to the industry.

Although this invention has been disclosed and illustrated with reference to a particular embodiment, the principles involved are susceptible for use in numerous other embodiments that will be apparent to persons skilled in the art. This invention is, therefore, to be limited only as indicated by the appended claims.

What is claimed is:

1. A stable current source circuit with a compensation circuit, comprising:

a PMOS current mirror, connected to a power supply so as to output a stable current; and an NMOS current mirror, connected to the PMOS current mirror, a third bipolar junction transistor, and a fourth compensation resistor, wherein the emitter of said third bipolar junction transistor is connected to said NMOS current mirror and both the base and the collector of said third bipolar junction transistor are grounded, wherein said fourth compensation resistor is interconnected between said NMOS current mirror and said compensation circuit, and wherein said compensation circuit includes a third resistor, and a second capacitor.

2. The stable current source circuit with a compensation circuit as claimed in claim 1, wherein said PMOS current mirror is composed of a seventh PMOS transistor and an eighth PMOS transistor with their gates connected.

3. The stable current source circuit with a compensation circuit as claimed in claim 1, wherein said NMOS current mirror is composed of a fifth NMOS transistor and a sixth NMOS transistor with their gates connected.

4. The stable current source circuit with a compensation circuit as claimed in claim 3, wherein one terminal of said fourth compensation resistor is connected to the source of said fifth NMOS transistor of said NMOS current mirror while the other terminal of said fourth compensation resistor is connected to the third resistor of said compensation circuit.

5. The stable current source circuit with a compensation circuit as claimed in claim 3, wherein the emitter of said third bipolar function transistor is connected to the source of said sixth NMOS transistor of said NMOS current mirror while the base and collector of said third bipolar junction transistor are grounded.

6. The stable current source circuit with a compensation circuit as claimed in claim 1, wherein one terminal of said third resistor of said compensation circuit is connected to said fourth compensation resistor of said compensation circuit while the other terminal of said third resistor is grounded.

7. The stable current source circuit with a compensation circuit as claimed in claim 1, wherein one terminal of said second capacitor of said compensation circuit is connected to a node where said third resistor and said fourth compensation resistor are connected while the other terminal of said second capacitor is grounded.

8. The stable current source circuit with a compensation circuit as claimed in claims 1, wherein said second capacitor is a parasitic capacitor.

9. A stable current source circuit with a compensation circuit, comprising:

a PMOS current mirror, connected to a power supply so as to output a stable current; and an NMOS current mirror, connected to said PMOS current mirror, a fourth bipolar junction transistor, and a sixth compensation resistor, wherein the emitter of said fourth bipolar junction transistor is connected to said NMOS current mirror and both the base and the collector of said fourth bipolar transistor are grounded, wherein said sixth compensation resistor is interconnected between said NMOS current mirror and said compensation circuit; and further comprising a fourth compensation capacitor, interconnected between the source and the drain of an NMOS transistor of said NMOS current mirror.

10. The stable current source circuit with a compensation circuit as claimed in claim 9, wherein said PMOS current mirror is composed of a tenth PMOS transistor and an eleventh PMOS transistor with their gates connected.

11. The stable current source circuit with a compensation circuit as claimed in claim 9, wherein said NMOS current mirror is composed of a seventh NMOS transistor and an eighth NMOS transistor with their gates connected.

12. The stable current source circuit with a compensation circuit as claimed in claim 11, one terminal of said sixth compensation resistor is connected to the source of said seventh NMOS transistor of said NMOS current mirror while the other terminal of said sixth compensation resistor is connected to a fifth resistor of said compensation circuit.

13. The stable current source circuit with a compensation circuit as claimed in claim 11, wherein two terminals of said fourth compensation capacitor are connected to the source and the drain of said seventh NMOS transistor, respectively.

14. The stable current source circuit with a compensation circuit as claimed in claim 9, wherein said compensation circuit comprises a fifth resistor, said sixth compensation resistor, a third capacitor and said fourth compensation capacitor.

15. The stable current source circuit with a compensation circuit as claimed in claim 14, wherein one terminal of said fifth resistor of said compensation circuit is connected to said sixth compensation resistor of said compensation circuit while the other terminal of said fifth resistor is grounded.

16. The stable current source circuit with a compensation circuit as claimed in claim 14, wherein one terminal of said third capacitor of said compensation circuit is connected to a node where said fifth resistor and said sixth compensation resistor are connected while the other terminal of said third capacitor is grounded.

17. The stable current source circuit with a compensation circuit as claimed in claim 14, wherein said fourth capacitor is a parasitic capacitor.

* * * * *